US009518583B2

(12) United States Patent
Pedrollo

(10) Patent No.: US 9,518,583 B2
(45) Date of Patent: Dec. 13, 2016

(54) SUBMERGED CENTRIFUGAL ELECTRIC PUMP

(75) Inventor: Silvano Pedrollo, San Bonifacio (IT)

(73) Assignee: PEDROLLO S.P.A., San Bonifacio (IT)

( * ) Notice: Subject to any disclaimer, the term of this patent is extended or adjusted under 35 U.S.C. 154(b) by 1288 days.

(21) Appl. No.: 13/500,399

(22) PCT Filed: Oct. 5, 2010

(86) PCT No.: PCT/IB2010/054499
§ 371 (c)(1),
(2), (4) Date: Apr. 5, 2012

(87) PCT Pub. No.: WO2011/042862
PCT Pub. Date: Apr. 14, 2011

(65) Prior Publication Data

US 2012/0195775 A1 Aug. 2, 2012

(30) Foreign Application Priority Data

Oct. 8, 2009 (IT) ..... BO2009A0650

(51) Int. Cl.
*F04B 17/03* (2006.01)
*F04D 13/08* (2006.01)
(Continued)

(52) U.S. Cl.
CPC ..... *F04D 13/08* (2013.01); *E21B 23/06* (2013.01); *E21B 33/00* (2013.01); *F04D 29/086* (2013.01); *F04D 29/628* (2013.01)

(58) Field of Classification Search
CPC ..... F04D 13/08; F04D 29/086; F04D 29/628; F04B 53/10; F04B 53/12; F04B 53/125; F04B 53/126; F04B 53/127; F04B 53/128; F04B 53/129; E21B 23/06; E21B 23/08
(Continued)

(56) References Cited

U.S. PATENT DOCUMENTS 3,022,739 A * 2/1962 Herrick ..... F04D 1/063 417/350
3,711,218 A * 1/1973 Kennel ..... F04D 7/04 415/131

(Continued)

FOREIGN PATENT DOCUMENTS

| | | |
|---|---|---|
| EP | 0774584 | 5/1997 |
| GB | 2 014 802 A | 8/1979 |
| WO | 2009/125363 A1 | 10/2009 |

*Primary Examiner* — Dominick L Plakkoottam

(74) *Attorney, Agent, or Firm* — McGlew and Tuttle, P.C.

(57) ABSTRACT

The submerged centrifugal electric pump comprises an external casing (2) comprising a first and a second tubular portion (5, 7) suitable to be connected coaxial to one another, a pumping unit (3) inserted axially in the first portion (5) of the casing (2) to suction a liquid through a suctioning opening (101) and transfer the liquid in outlet through a discharge opening (11), and a motor unit (4) inserted in the second tubular portion (7) of the casing (2) and provided with a motor shaft (15) suitable to be connected in use to the pumping unit (3). The centrifugal electric pump comprises means (19) for fixing the axial position of the motor shaft (15) interposed between the motor unit (4) and the pumping unit (3). The fixing means (19) comprise an occlusion member (20) having an elastic material portion (23) suitable to engage the internal surface of the casing (2), a support body (22) suitable to be axially linked to the occlusion member (20) and a fastening member (21) suitable to be associated with the occlusion member (20) to perform the radial expansion of the elastic material portion (23).

16 Claims, 3 Drawing Sheets

(51) Int. Cl.

| | |
|---|---|
| ***E21B 23/06*** | (2006.01) |
| ***E21B 33/00*** | (2006.01) |
| ***F04D 29/08*** | (2006.01) |
| ***F04D 29/62*** | (2006.01) |

(58) Field of Classification Search
USPC ..... 417/545, 547, 548, 552, 554; 166/68, 166/105, 105.1, 106, 110, 109, 167, 169, 84.5
See application file for complete search history.

(56) References Cited

U.S. PATENT DOCUMENTS

| | | | | |
|---|---|---|---|---|
| 3,746,472 | A * | 7/1973 | Rupp | F04D 15/0263 277/320 |
| 4,015,633 | A * | 4/1977 | Mandell | F16J 15/52 138/109 |
| 4,042,847 | A * | 8/1977 | Jensen | F16J 15/164 310/87 |
| 4,523,899 | A | 6/1985 | Ouchi | |
| 5,030,018 | A * | 7/1991 | Korenblit | F01C 21/102 384/519 |
| 6,893,213 | B1 * | 5/2005 | Quill | F04D 29/628 415/131 |
| 7,290,984 | B2 | 11/2007 | Volk | |
| 2003/0198554 | A1 * | 10/2003 | Ray | F04D 29/108 415/112 |
| 2006/0250754 | A1 | 11/2006 | Schlosser | |

* cited by examiner

SUBMERGED CENTRIFUGAL ELECTRIC PUMP

TECHNICAL FIELD

The present invention regards a centrifugal electric pump, in particular of the submerged type.

BACKGROUND ART

It is known that, in order to transfer a liquid from a reservoir to a usage station arranged at higher height, generally, pumping members are used, such as in particular submerged pumps. Known submerged pumps are generally provided with an external tubular casing provided with a plurality or radial openings for liquid inlet, normally referred to as suctioning openings, and with an outlet opening, referred to as discharge opening. There are accommodated inside the casing the pump operating members, constituted of a pumping unit and a motor unit generally of the electrical type, suitable to operate the liquid transfer from the suctioning openings to the discharge opening.

The pumping unit is usually constituted of one or more stages, each of which comprising a rotating member or impeller, suitable to be actuated in rotation by the motor unit shaft, and by stationary members suitable to convey the liquid from one stage to another, up to the discharge opening.

U.S. Pat. No. 7,290,984 for example illustrates a centrifugal pump with multiple stages, in which each stage is constituted of an impeller unit, a disc unit and a distributor unit, arranged around a motor shaft. The hub of the impeller is provided with floating sealing means, supported by the diffuser unit, suitable to reduce the liquid recirculation. A thrust ring is provided, arranged around the motor shaft and suitable to engage the hub of the impeller and the above mentioned impeller hub sealing means. Lastly, a friction coupling ring is provided, fixed against the disc unit and suitable to engage a corresponding surface of the impeller.

A problematic aspect of the electric pumps of the known type, and in particular of the submerged pumps, regards protecting the electric motor and the electric connections against the liquid transferred from the pumping member. To this aim, there is usually shaped in the electric pumps of the prior art, inside the casing, a special motor chamber suitable to be separated, by means of mechanical sealing means, both from the liquid present outside the casing, and from the liquid that passes through the pumping member.

Connected with such problem is the need, especially common for the submerged electric pumps, to check the operating members present inside the external tubular casing. As a matter of fact, this type of electric pumps is often used to operate on liquids that, though filtered, still contain dirt particles. In order to prevent the mechanical components from being worn by such particles, it is necessary to check and cyclically clean the mechanical parts in contact with the liquid. However, in the electric pumps of the known art it is difficult to combine the need for a perfect protection of the electric motor with the need to easily disassemble and reassemble the parts forming the casing to perform the maintenance operations of the electric pumps.

In an attempt to solve the above mentioned problems, different types of devices for fastening and connecting the parts constituting the electric pumps have been proposed. For example, U.S. Pat. No. 4,523,899 illustrates a submerged electric pump of the multistage type provided with two tubular portions which comprise respectively a motor unit and a pumping unit, coaxially connected through an elastic joint member. Such joint member is suitable to insulate the portion which contains the motor unit from the lubrication liquid.

Patent EP0774584 illustrates a different type of sealing connection means intended to be used in electric pumps of the submerged type. In particular, it is provided a device for mounting and for connecting the parts forming a pumping unit. Such pumping is provided with two connection units with screws arranged peripherally and in an alternating manner. The first connection unit connects by means of a sealing ring a first shell suitable to hold the stator member of the motor unit and a second shell suitable to hold the lubricating fluid. The second connection unit connects such sealing ring, a third shell of the pumping member, and an external cooling casing that surrounds the shell of the stator member.

However the proposed solutions do not allow to satisfactorily overcome the above mentioned drawbacks, in that they comprise expensive and complex fixing devices, that require long and complicated mounting and dismounting operations. In particular, such problems are more significant in the case of the electric pumps of relatively small dimensions, with diameters of the motor member comprised for example between 2 and 10 inches, for which it is more difficult to provide fixing solutions that facilitate the partial dismounting of the different operating parts.

Another problem unsolved by the electric pumps of the known art stands in the fixing of the axial position of the motor shaft. The aforesaid electric pumps comprise rolling means connected to the motor shaft and fixed to parts of the pump made through moulding. These elements have thus dimensional inaccuracies that do not enable to determine precisely the positioning of the motor shaft.

DISCLOSURE OF INVENTION

The task of the present invention is that of solving the aforementioned problems, devising a submerged centrifugal electric pump which provides a reliable junction of the different parts, in such a way as to protect the motor members from the surrounding liquid.

Within such a scope, it is a further object of the invention that of providing a submerged centrifugal electric pump that can be mounted and dismounted in an easy and quick way, in particular in the case of electric pumps having relatively reduced dimensions.

Another object of the present invention is that of providing a submerged centrifugal electric pump having a simple conception, a securely reliable functioning and versatile use, as well as relatively economic cost.

The above mentioned scopes are attained, according to the present invention, by the submerged centrifugal electric pump according to claim 1.

BRIEF DESCRIPTION OF THE DRAWINGS

Details of the invention shall be more apparent from the detailed description of a preferred embodiment of the centrifugal electric pump, illustrated for indicative purposes in the attached drawings, wherein.

BEST MODES OF CARRYING OUT THE INVENTION

Figure 1:
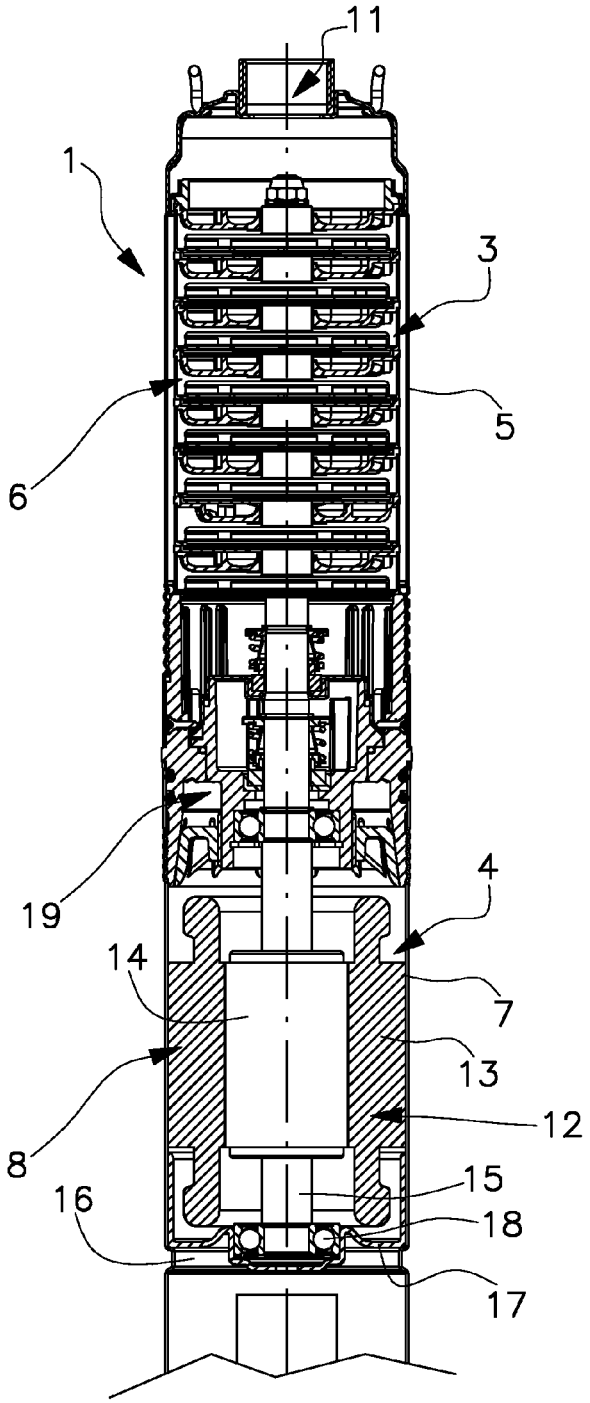
FIG. 1 shows an axial cross sectional, partly broken, view of the submerged centrifugal electric pump according to the present invention.
Figure 2:
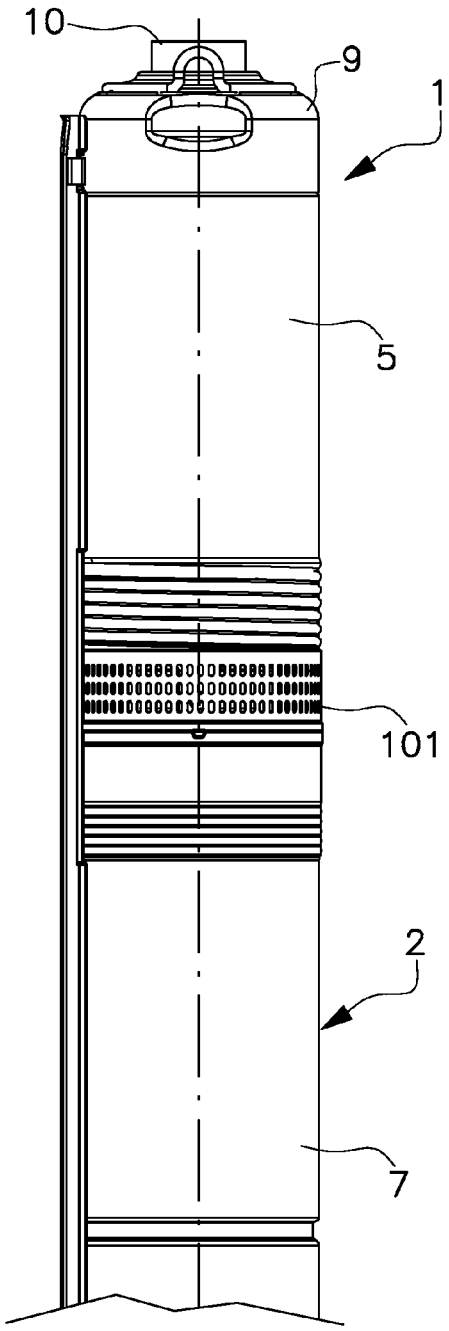
FIG. 2 shows a corresponding front view of the same electric pump.

With particular reference to such figures, the submerged centrifugal electric pump is indicated in its entirety with 1. The electric pump 1 comprises a tubular shaped external casing 2, for example cylindrical, preferably made of metal plate having a suitable thickness. The casing 2 is suitable to contain the operating members of the pump, in particular a pumping unit 3 and a motor unit 4, already known. The casing 2 comprises preferably a first tubular portion 5 suitable to define internally a first compartment or chamber 6 for housing the pumping unit 3, and a second tubular portion 7, in use arranged coaxial to the first tubular portion 5, suitable to define internally a second compartment or chamber 8 for housing the motor unit 4. The casing 2 is closed at the opposite ends by an upper cover 9 and a lower cover not illustrated.

The first tubular portion 5 of the casing 2 carries, in proximity of the end suitable for coupling to the second tubular part 7, a plurality of openings 101 for suctioning the liquid, preferably distributed radially in a regular way and placed beside on various circumferences.

The upper cover 9 axially configures a tubular projection 10 suitable to internally define a discharge duct 11 for the liquid fed by the pumping member 3 through the inlet openings.

The motor unit 5 comprises an electric motor 12 constituted by a stator 13 and by a rotor 14 keyed on a motor shaft 15 designed to be connected in use to the pumping unit 3. Should the electric motor 12 be of the single-phase type, there is provided a capacitor member, not illustrated, housed inside the second chamber 8 in proximity of the end closed by the lower cover. More precisely, the motor member 12 is electrically connected to the capacitor member and to a power supply unit, not represented, arranged outside the electric pump 1. The electric connection with such a power supply unit occurs through electric cables passing through the lower cover.

Furthermore, the second tubular portion 7 has an annular narrowing 16 suitable to act as an abutment, inside the second chamber 8, for positioning the stator 13. At such a narrowing 16, the end of the motor 12 is contained in a cap 17 which supports the end of the shaft 15 by means of the interposition of suitable rolling support members 18 of the sphere bearings type or the like.

At the opposite end, the motor shaft 15 extends in the first chamber 6, where is housed the pumping unit 3 that, in the illustrated case, if of the multistage type. It is to observe that the motor shaft 15 is made in continuous form in FIG. 1; in FIG. 3 is instead illustrated a different embodiment wherein the motor shaft is made of different parts reciprocally constrained by a suitable junction member.

According to the present invention, the electric pump 1 comprises means 19 for fixing the axial position of the motor shaft 15 interposed between the motor unit 4 and the pumping unit 3. The fixing means 19 are arranged at the upper end of the second tubular portion 7 of the casing 2 to protect the motor unit 4 accommodated in the second chamber 8 from the liquid suctioned by the pumping unit 3.

Figure 3:
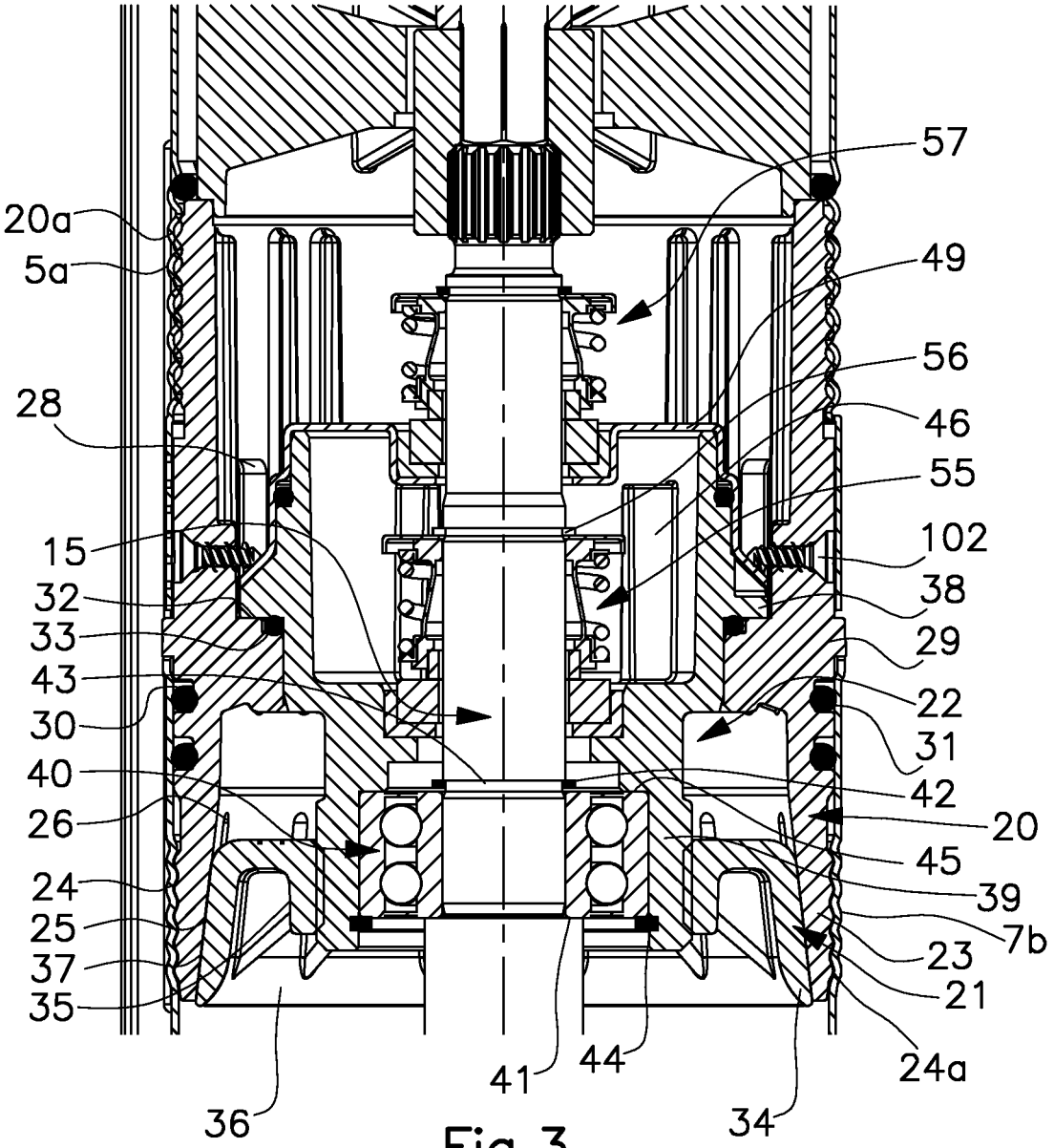
FIG. 3 shows an axial cross sectional view of a central part of the electric pump, at the zone of connection of tubular parts of the external casing of the same electric pump.

The fixing means 19 comprise an occlusion member 20 which is suitable to be tightened elastically against the internal wall of the casing 2 by means of a fastening member 21 (see FIG. 3). The occlusion member 20 and the fastening member 21 are associated, as clarified in the following, with a support body 22.

The occlusion member is made like a ring nut from a tubular shaped body, suitable made of rubber or in alternative of fluoroelastomer commercially known as Viton or of plastic material, suitable to be inserted coaxial inside the casing 2, close to the internal wall of the second tubular portion 7. At the end directed in use towards the second chamber 8, the occlusion member 20 shapes an annular tract or portion 23 having a first external operating side 24 and a second internal operating side 25 having a frusto-conical shape, suitable to be engaged by the fastening member 21, to obtain the tight on the internal wall of the casing 2. The annular tract 23 has a series of longitudinal notches 26, angularly distributed, suitable to separate the same annular tract 23 in a series of sectors; the notches 26 are suitable to be engaged by corresponding fins 27 of the fastening member 21. At the external side 24, the annular tract 23 is provided with a circumferential crease **24*a* suitable to be engaged by a conjugated crease 7*b* made on the wall of the second tubular portion 7 of the casing 2**.

At the opposite end, the occlusion member 20 is suitable to be inserted partially inside the first tubular portion 5 of the casing 2. At such portion, the occlusion member 20 has a series of slits 28, angularly distributed, in order to allow the passage of the liquid from the outside of the electric pump to the first chamber 6, through the external openings of the first tubular portion 5 of the casing 2.

At the aforesaid end, the occlusion member 20 has a further crease **20*a* suitable to engage a further conjugated crease 5*a* of the first tubular portion 5 of the casing 2**.

Externally, in a substantially median position, the occlusion member 20 has an annular projection 29 designed to act as a stop for the axial positioning. Between such annular projection 29 and the annular tract 23 of the occlusion member 20 there are usefully realized a couple of annular grooves 30 for housing respective tight rings 31.

Internally, in a substantially median position, the occlusion member 20 further configures an annular shoulder 32, destined to act as a stop for housing the support body 22, as well as a seat for housing a tight ring 33.

The fastening member 21 is constituted by an annular portion 34 connected to a central portion 35 through a series of radial ribs 36. The annular portion 34 has a frusto-conical shape so as to define externally an operating surface 37 substantially conjugated to the surface defined by the second operating side 25 of the annular tract 23 of the occlusion member 20.

The central portion 35 is constituted by a sleeve internally threaded for coupling to the support body 22. The support body 22 is constituted by a substantially tubular shaped body, preferably made of brass, of cast iron, or of another suitable material. At a substantially median portion, the support body 22 profiles externally a collar 38 suitable to abut the annular shoulder 32 of the occlusion member 20.

At one end, the support body 22 is suitable to be housed inside the second chamber 8 of the casing 2. At the opposite end, beyond the collar 38, the support body 22 is suitable to be housed inside the first chamber 6. The end of the support body 22 directed in use towards the inside of the second chamber 8 is constituted by a threaded head 39 suitable to be coupled to the threaded sleeve 35 of the fastening member 21.

Inside the threaded head 39 there is arranged a rolling thrust bearing member 40 suitable to support the motor shaft 15. The thrust bearing member 40 comprises an internal part blocked between a shoulder 41 of the motor shaft and a ring 42 engaged in a groove 43 of the motor shaft 15, and an external part blocked between a ring 44 and an internal shoulder 45 of the support body 22. The positioning of the rolling thrust bearing member 40 is therefore determined by the mechanical manufacture of the support body 22.

The opposite end of the support body 22 shapes internally a series of manoeuvring ribs 46 distributed angularly around the axis of the same support body 22, suitable to allow the mounting and the dismounting of the fixing means 19. More precisely, the manoeuvring ribs 46 are suitable to by engaged by a manoeuvring tool 47 at respective notches 48, to allow, by means of the axial rotation of the body 22, the coupling to the fastening member 21, or vice versa, the dismounting thereof (see FIG. 6).

The same end of the support body 22 is closed, in use, by a covering cap 49 that has a central opening for the passage of the motor shaft 15 and is fixed by means of a plurality of screws 102 arranged transversally and angularly distributed around the axis of the support body 22. The screws 102, for example self-tapping, are inserted passing through the wall of the occlusion member 20 so as to compress with their own end the edge of the cap 49 against the support body 22.

The cap 49, which internally defines a chamber for the lubricating fluid, has an access hole 52, in order to realize, before carrying out, possible tight tests on the same chamber. Such access hole is closed, in use, by suitable screw means 53. The functioning of the submerged centrifugal electric pump according to the invention is described in the following.

The electric motor 12 is inserted inside the second chamber 8 defined by the second tubular portion 7 of the casing 2, abutting against the annular narrowing 16. Successively the electric cables are inserted for the connection to the external power supply unit.

Figure 4:
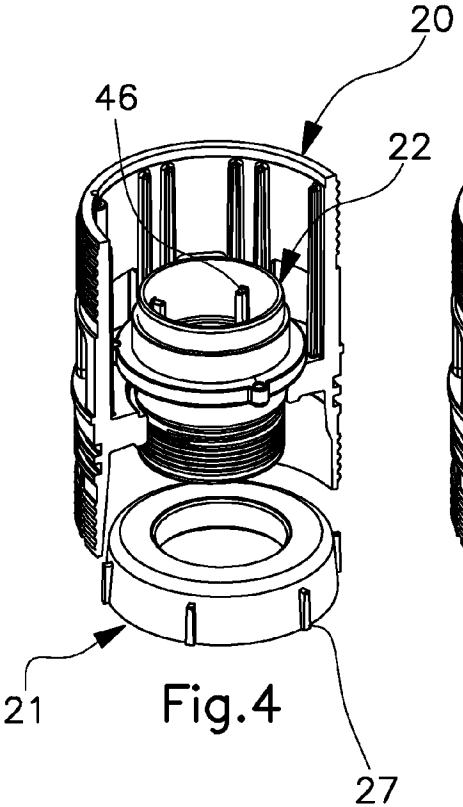

Preferably the unit constituted by the occlusion member 20, the fastening member 21 and the support body 22 is separately pre-mounted. To such end, the support body is first inserted coaxial inside the occlusion member 20 (FIG. 4), until the collar 38 of the support body 22 reaches in abutment the annular shoulder 32 of the occlusion member 20. From the opposite end of the occlusion member 20 is prearranged axially the fastening member 21, so as to insert the fins 27 inside the notches 26 of the occlusion member 20.

Figure 5:
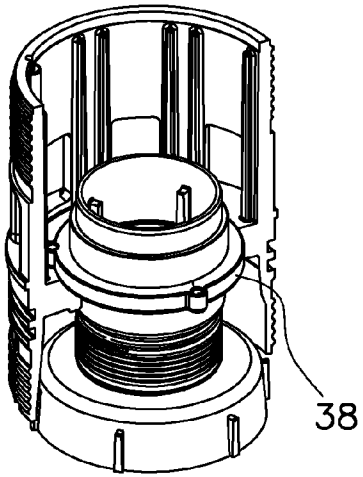

At this point the support body 22 is rotated to operate the fastening of the fastening member 21 (FIG. 5). A first step of rotation of the support body 22 determines the engagement of the threaded head 39 in the first threads of the threaded sleeve 35. It is important to note that the rotation of the support body 22 does not trail in rotation the sleeve 35 of the fastening member 21, since this latter is retained by the fins 27 inserted in the notches 26 of the occlusion member 20. Such rotation movement only determines a displacement of the fastening member 21.

The rolling support member 40 is thus mounted separately at interference on the motor shaft 15, with the internal part abut ting against the shoulder 41 of the motor shaft 15. This same external part is blocked by the insertion of the ring 42 in the groove 43 of the motor shaft 15. At this point the aforesaid premounted unit is inserted around the motor shaft 15 so as to house the rolling support member 40 inside the threaded head 39 of the support body 22, the external part of the rolling member 40 being put in abutment against the internal shoulder 45 of the support body 22. The ring 44 is thus inserted under the rolling support member 40 so as to block the external part of the rolling member 40 inside the threaded head 39 of the support body 22.

Figure 7:
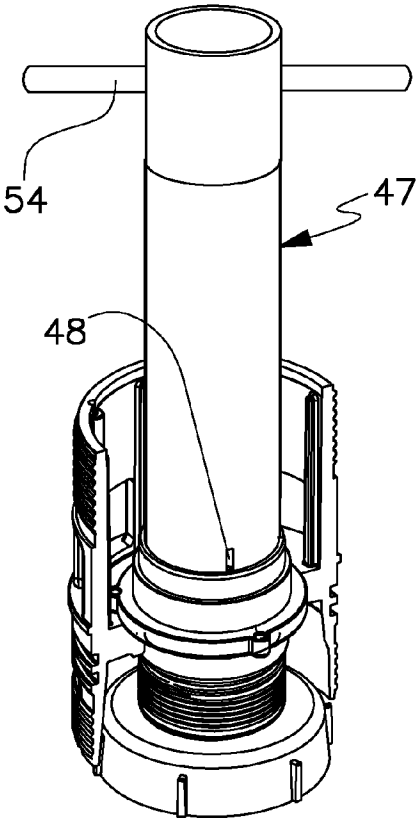
FIGS. 4, 5, 6 and 7 show a prospective view of steps for mounting said electric pump.
Figure 6:
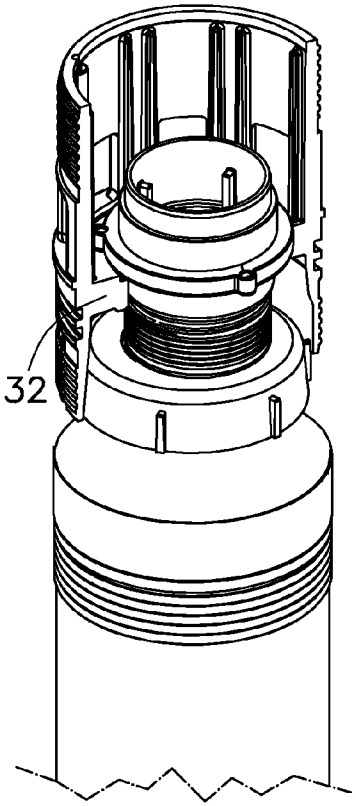

The motor shaft 15 fastened to the fixing means 19 is inserted in the second tubular portion 7 through the open end of the casing 2 (FIG. 6). The unit is correctly inserted when the annular projection 29 reaches at contact the end edge of the second tubular portion 7. To complete the tight fastening of the unit, the support body 22 is further rotated (FIG. 7). The rotation of the support body 22 is executed usefully through the aid of the manoeuvring tool 47. Practically, the notches 48 of the tool 47 are inserted in the manoeuvring ribs 46, so as to enable the rotation thereof integral to the support body 22 by means of a suitable control gripping 54.

Such rotation, as previously said, determines the axial displacement of the fastening member 21. As a consequence of the frusto-conical conformation of the operating surface 37 of the annular portion 34, the annular tract 23 is compressed and elastically expanded in radial direction against the internal wall of the second tubular portion 7, achieving the desired fixing.

On the motor shaft 15 is inserted a first mechanical tight unit 55 of the type per se known, held in position against a respective stop ring 56 prearranged abutting against a suitable shoulder of the shaft 15.

On an upper part of the first mechanical tight unit 55 is inserted, around the shaft 15, the covering cap 49, closing the head of the support body 22 and the occlusion member 20. The cap 49 is fastened by means of the screws 102. Over the cap 49 is prearranged on the motor shaft 15 a second mechanical tight unit 57 similarly to the first mechanical tight unit 55. The second mechanical tight unit 57 cooperates with the first mechanical tight unit 55 to warrant the separation of the chamber for the lubricating fluid, defined internally by the cap 49, from the second chamber 8, on one side, and from the first chamber 6, on the other side.

Finally the pumping unit 3 is mounted on the motor shaft 15 in a known manner. The first tubular portion 5 is inserted, abutting against the stop 29 of the ring nut 20. Eventually the cover 9 is superimposed, completing the mounting operations. The centrifugal electric pump according to the invention attains the scope of providing a reliable junction of the tubular portions 5, 7 of the casing 2.

Such result is attained in particular thanks to the radial expansion of the portion 23 made of elastic material of the occlusion member 20 of the fixing means 19 operated by means of the fastening member 21. Such expansion determines in a safe way the fastening of the aforesaid elastic material portion 23 of the occlusion member 20 on the internal wall of the casing 2.

It is important to note that in the case of the fixing means 19, the tight is mainly achieved by the first and second mechanical tight means 55, 57 and by the tight rings 31, 33 respectively.

A characteristic of the invention consists of the fact that the fastening is warranted in any condition and precision level of the mechanical components of the electric pump or of the driving apparatus comprising the described fixing means 19. In fact the cited elastic expansion turns out to be efficient even if the tubular casing 2 is not perfectly cylindrical, but results for example ovaled. Furthermore it is to note that the expansion fastening according to the invention enables to manufacture the casing 2, usually made of steel, with minor interference with respect to the closing mechanical parts. This latter may thus be mounted more easily.

A further aspect of the invention consists of the fact that the claimed expansion fastening is made by means of a small number of mechanical pieces, the dimensional accuracy of which influences in a small manner on the efficiency of the closure, which is warranted anyway by the elastic behaviour of the elastic material portion 23 of the occlusion member 20.

Another advantage of the electric pump object of the invention is that of being suitable to be mounted and dismounted easily. In particular, dismounting of the fixing means 19 occurs operating the rotation of the support body 22, in the direction suitable to take the fastening member 21 away from the annular tract 23, so as to determine the elastic return from the radial expansion condition, freeing the same annular tract 23 from the internal wall of the casing 2.

It is to note that with the electric pump according to the present invention the simple dismounting of the support body 22 creates a circular opening with a diameter such as to enable the passage of the rolling support member 40, of the rotor 14 or of the support member 18, allowing to change these elements without having to dismount the occlusion member 20 and the fastening member 21.

A further advantage of the invention stands in the optimal draining of the heat that develops between the parts in relative movement, mainly the mechanical tights between the motor shaft 15 and the fixed parts. This is mainly due to the presence of the support body 22 made up on purpose of heat conductive material, preferably brass. Such material warrants a fast and efficient draining of the produced heat, and enables to realize accurately the coupling with the fastening member 21.

Another advantage is in the fact that the positioning of the rolling thrust bearing members 40 is determined by the mechanical manufacturing of the manoeuvring member and of the occlusion member 20, such working is made in a precise way, allowing to keep the protruding of the motor shaft 15 in the tolerance according to the provisions in force, without further corrections.

The fixing means 19 turn out to be safe and reliable against possible causes of unscrewing. In particular the fixing means 19 are firmly fastened by virtue of the screws 102 that transversely block the support body 22.

In practice, the embodiment of the invention, the materials used, as well as the shape and dimensions, may vary depending on the requirements.

Should the technical characteristics mentioned in each claim be followed by reference signs, such reference signs were included strictly with the aim of enhancing the understanding the claims and hence they shall not be deemed restrictive in any manner whatsoever on the scope of each element identified for exemplifying purposes by such reference signs.

The invention claimed is:

1. A submerged centrifugal electric pump, comprising:

a tubular-shaped external casing comprising a first tubular portion and a second tubular portion suitable to be connected coaxial to each other;

a pumping unit axially inserted into a first chamber defined in said first tubular portion of said casing to suction a liquid through a suctioning opening and transfer said liquid through a discharge opening;

a motor unit axially inserted into a second chamber defined in said second tubular portion of said casing and provided with a motor shaft to be operatively connected to said pumping unit;

a means for fixing an axial position of said motor shaft interposed between said motor unit and said pumping unit and said means for fixing comprising a substantially tubular-shaped occlusion member having an elastic material portion for engaging an internal surface of said casing in correspondence of a connecting end of said second tubular portion to said first tubular portion;

a tubular-shaped support body for being inserted coaxial inside said casing and axially linked to said occlusion member;

a fastening member associated with said occlusion member to perform a radial expansion of said elastic material portion, so as to fasten the elastic material portion against said internal surface of said casing, said elastic material portion of said occlusion member having an internal operating side, said internal operating side having a substantially frusto-conical abutment surface, in correspondence of a zone for engaging said fastening member; and a rolling support means associated with said motor shaft for holding axial thrust, and inserted into a seat made in said support body, said rolling support means comprising a thrust bearing member provided with an internal part, blocked between a shoulder of said motor shaft and a ring engaged in a groove of the motor shaft, and an external part blocked between a ring engaged in the support body and an internal shoulder of the support body.

2. An electric pump according to claim 1, wherein said elastic material portion of the occlusion member has a series of longitudinal notches angularly distributed for engaging corresponding fins of said fastening member.

3. An electric pump according to claim 1, wherein said elastic material portion of said occlusion member has, on the external side, circumferential creases for engaging conjugated creases made respectively on a wall of said first tubular portion and said second tubular portion of the casing.

4. An electric pump according to claim 1, wherein said occlusion member has internally, in a substantially median position, an annular shoulder for functioning as a stop for a collar profiled externally from said support body.

5. An electric pump according to claim 1, wherein said fastening member shapes a frusto-conical shaped annular portion connected to a central portion internally threaded for coupling to said support body.

6. A submerged centrifugal electric pump, comprising:

a tubular-shaped external casing comprising a first tubular portion and a second tubular portion, said first tubular portion being connected to said second tubular portion, said first tubular portion defining a first chamber, said second tubular portion defining a second chamber;

a pumping unit inserted into said first chamber;

a motor unit axially inserted in said second chamber, said motor unit comprising a motor shaft, said motor shaft being operatively connected to said pumping unit, said motor shaft comprising a motor shaft groove;

a fixing means for fixing an axial position of said motor shaft between said motor unit and said pumping unit and said fixing means comprising a substantially tubular-shaped occlusion member having an elastic material portion for engaging an internal surface of said casing;

a tubular-shaped support body inserted in said casing and axially linked to said occlusion member, said occlusion member having internally, in a substantially median position, an annular shoulder for functioning as a stop for a collar profiled externally from said support body;

a fastening member associated with said occlusion member to perform a radial expansion of said elastic material portion, so as to fasten the elastic material portion against said internal surface of said casing; and a rolling support structure associated with said motor shaft, said rolling support structure being inserted in a seat of said support body, said rolling support structure comprising a thrust bearing member provided with an internal part, said thrust bearing comprising a ring, said internal part being arranged between a shoulder of said motor shaft and said ring, at least a portion of said ring being arranged in said motor shaft groove, said thrust bearing comprising an external part arranged between another ring engaged in the support body and an internal shoulder of the support body.

7. An electric pump according to claim 6, wherein said elastic material portion of the occlusion member has a first external operating side, facing in use said internal surface of the casing, and an opposite second internal operating side for engaging said fastening member, to provide a seal on said internal surface of the casing.

8. An electric pump according to claim 7, wherein said second internal operating side has a substantially frusto-conical abutment surface, in correspondence of a zone for engaging said fastening member.

9. An electric pump according to claim 6, wherein said elastic material portion of the occlusion member has a series of longitudinal notches angularly distributed for engaging corresponding fins of said fastening member.

10. An electric pump according to claim 6, wherein said elastic material portion of said occlusion member has, on the external side, circumferential creases for engaging conjugated creases made respectively on a wall of said first tubular portion and said second tubular portion of the casing.

11. An electric pump according to claim 6, wherein said fastening member shapes a frusto-conical shaped annular portion connected to a central portion internally threaded for coupling to said support body.

12. A submerged centrifugal electric pump, comprising:

an external casing comprising a first tubular portion and a second tubular portion, said first tubular portion being connected to said second tubular portion, said first tubular portion defining a first chamber, said second tubular portion defining a second chamber;

a pumping unit arranged in said first chamber;

a motor unit arranged in said second chamber, said motor unit comprising a motor shaft, said motor shaft being operatively connected to said pumping unit, said motor shaft comprising a motor shaft groove;

a fixing means for fixing an axial position of said motor shaft between said motor unit and said pumping unit, said fixing means comprising a substantially tubular-shaped occlusion member having an elastic material portion for engaging an internal surface of said casing;

a support body arranged in said casing, said support body being connected to said occlusion member;

a fastening member associated with said occlusion member to provide a radial expansion of said elastic material portion such that the elastic material portion is fastened against said internal surface of said casing, said fastening member shaping a frusto-conical shaped annular portion connected to a central portion internally threaded for coupling to said support body; and a rolling support structure associated with said motor shaft, said rolling support structure being inserted in a seat of said support body, said rolling support structure comprising a thrust bearing member comprising an internal part and a ring, said internal part being arranged between a shoulder of said motor shaft and said ring, at least a portion of said ring being arranged in said motor shaft groove, said thrust bearing comprising an external part arranged between another ring engaged in the support body and an internal shoulder of the support body.

13. An electric pump according to claim 12, wherein said elastic material portion of the occlusion member has a first external operating side, facing in use said internal surface of the casing, and an opposite second internal operating side for engaging said fastening member, to provide a seal on said internal surface of the casing, said second internal operating side having a substantially frusto-conical abutment surface, in correspondence of a zone for engaging said fastening member.

14. An electric pump according to claim 12, wherein said elastic material portion of the occlusion member has a series of longitudinal notches angularly distributed for engaging corresponding fins of said fastening member.

15. An electric pump according to claim 12, wherein said elastic material portion of said occlusion member has, on the external side, circumferential creases for engaging conjugated creases made respectively on a wall of said first tubular portion and said second tubular portion of the casing.

16. An electric pump according to claim 12, wherein said occlusion member has internally, in a substantially median position, an annular shoulder for functioning as a stop for a collar profiled externally from said support body.

* * * * *